US005695191A

United States Patent [19]

Frost

[11] Patent Number: 5,695,191

[45] Date of Patent: Dec. 9, 1997

[54] METHOD AND APPARATUS FOR A KONANE GAME

[76] Inventor: Christopher Frost, P.O. Box 390413, Kailua-Kona, Hi. 96739

[21] Appl. No.: 785,433

[22] Filed: Jan. 17, 1997

[51] Int. Cl.[6] ..... A63F 3/02

[52] U.S. Cl. ..... 273/260; 273/286

[58] Field of Search ..... 273/242, 260, 273/261, 262, 286

[56] References Cited

U.S. PATENT DOCUMENTS

| | | | |
|---|---|---|---|
| 509,316 | 11/1893 | Lapham | 273/286 |
| 1,269,276 | 6/1918 | Harris | 273/286 |
| 2,667,353 | 1/1954 | Lanice | 273/286 |
| 4,673,184 | 6/1987 | Sanores | 273/286 |
| 5,257,787 | 11/1993 | Miccio | 273/260 |
| 5,497,998 | 3/1996 | Horton | 273/286 X |

*Primary Examiner*—William E. Stoll

*Attorney, Agent, or Firm*—Michael R. McKenna

[57] ABSTRACT

The invention relates to a new transportable konane game with a pouch that opens into a playable flat surface and new rules of play.

14 Claims, 6 Drawing Sheets

METHOD AND APPARATUS FOR A KONANE GAME

BACKGROUND OF THE INVENTION

Long before the day that Captain Cook first stumbled upon Hawaii, konane was already an ancient game of the Hawaiians. Konane is a simple yet challenging game.

The instant invention is a variation of the ancient Hawaiian game of Konane where stone slabs, flat tops of boulders, or the ledge near a house site, with the surface pitted with rows of holes were used as a game board. The pits averaged about an inch apart, 2/10ths of an inch deep and 5/10ths of an inch in diameter. They were commonly arranged in 9 by 9 grids and many such natural game boards can be found in Hawaii with varying grid configurations.

The playing pieces used in the ancient game were black beach pebbles and white coral pebbles. In the ancient game of Konane, two players sat opposite with the game board set between them. Under one version of the ancient game, once the playing pieces have been set, then it is decided who shall pick up the first playing piece, which must be at the center or at a corner of the board. If the first person to choose picks up a black playing piece next to the center, then his opponent must pick up a white center piece; but if he picks up a black corner piece, then his opponents must pick up a white corner from one side or the other of the corner. If a player cannot jump in turn, the game is ended and the blocked player loses. Under the ancient rules, jumping never proceeds in two directions in one move, and never diagonally. "The Island of Lanai A Survey of Native Culture", by Kenneth P. Emory, pp. 84–85, Pitted Slabs for the Game of Konane.

In the rules of Konane distributed by the National Park Service, U.S. Department of Interior, the board has 100 stones with ten rows and ten columns in a square pattern. Fifty dark pieces and fifty light pieces are employed. Movement again is restricted to only one direction in a turn.

The principal disadvantage of such devices is that neither of the foregoing Konane games permits the method of play taught by this important invention. To alleviate the problem inherent in the restrictive rules of the ancient game, the method of play of the present invention allows each player to move in more than one direction during a turn which opens up the game to a greater variety of moves and speeds up play. Moreover, the structure of the present invention is unique in that game are required to be played on a board grid where the number of rows are either one greater or one less than the number of columns.

Another disadvantage to all of the foregoing devices is that they provide for an immovable game site. A preferred embodiment of the present invention provides for a portable game with a flexible sheet that may be flattened to serve as the game board or folded to create a pouch or sack for the playing pieces to be moved about.

Reference can also be made to other board games which are foldable and portable such as the one disclosed in U.S. Pat. Nos. 5,419,564 and 5,308,080, both issued to Lamie, which provides for a game played on a foldable surface with strings that may be drawn to form a carrying bag. See also U.S. Pat. Nos. 4,842,133; 4,712,673; and U.S. Design Pat. No. 336,362 which disclose other foldable game boards, none of which detract from the invention disclosed herein.

Another advantage of the instant invention is that a separate game playing surface and a cover sheet are provided. This allows the flat sheet of the playing surface to made portable merely by folding over the four corners, leaving only the peripheral edge of the cover sheet to be scrunched when the rope is drawn to create the sack. This allows for a greater variety of materials to be used for the playing surface—material that is not necessarily as flexible nor as resilient as it would have to be if it were scrunched by the drawn rope and then flattened to serve as the game board surface.

In the preferred embodiment of this invention the flexible sheet can be preferably made from a light weight canvas and the cover sheet from a lightweight cloth. The playing pieces can be made respectively of two sets of colored stones, white and black are traditional, or any hard plastic or reasonable alternative.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing konane games which teach stationary structures that support the game, the present konane game is designed to be portable. Accordingly, a user of this can turn the playing surface into a sack and move the game to another site.

Another advantage of the instant invention is that a separate game playing surface and a cover sheet may be provided, allowing the flat sheet of the playing surface to made portable merely as the four corners are folded over when the rope is drawn scrunching the peripheral edge of the cover sheet to create the sack. This allows for a greater variety of materials to be used for the playing surface—material that is not necessarily as flexible nor as resilient as it would have to be if it were scrunched by the drawn rope and then flattened to serve as the game board surface.

Other advantages of the present invention include a unique structure for the board grid where the number of rows are either one greater or one less than the number of columns.

Moreover, the method of play of the present invention allows each player to move in more than one direction during a turn which opens up the game to a greater variety of moves and speeds up play.

Still other advantages will be apparent from the disclosure that follows.

SUMMARY OF THE INVENTION

The invention relates to a new konane game, playable on a generally flat surface, comprising a flexible sheet that may be made flat. The flexible sheet has a first surface and a second surface. The first surface of the sheet has a plurality of parallel rows with each row being defined by a plurality of generally evenly spaced marks, where each mark from a row forms one of a series of marks of one of a series of parallel columns with each of the columns being transverse to each of the plurality of parallel rows.

The konane game further comprises a plurality of first objects and a plurality of second objects corresponding generally in number to the plurality of first objects. The first objects are distinguishable from the second objects, and the first objects and the second objects are each suitably sized to be placed on the marks of the first surface of the sheet free of interfering with the placement of any one of the first objects and the second objects positioned on an adjacent mark.

The game further comprises at least one rope. The rope is disposed adjacent to the second surface of the sheet, whereby, the at least one rope may be drawn independent of any contact with the placement of any one of the first objects and the second objects on the first surface.

The game which is for a first player and a second player is played by providing at least ten playing pieces of a first designation for use by the first player and at least ten playing pieces of a second designation for use by the second player, and providing a playing area divided into adjacent playing piece zones, each zone for receiving only a single playing piece at any one time, the adjacent playing piece zones arranged in a n by n+1 grid forming distinct, serially linked, horizontal and vertical rows.

The konane game procedure further provides for placing of one of the playing pieces of the first designation on any one of the playing piece zones, to fill the playing piece zone, placing of one of the playing pieces of the second designation on each of the playing piece zones horizontally and vertically adjacent to the playing piece zone filled on the previous step, and placing of one of the playing pieces of the first designation on each of the playing piece zones horizontally and vertically adjacent to the playing piece zone filled on the previous step. The last referenced placement by the first player and the second player is repeated until all playing piece zones are filled.

Then the first player removes one of the playing pieces of the first designation from the playing area by the first player, to create a vacant playing zone. The second player removes one of the playing pieces of the second designation from the playing area, whereby a second vacant playing zone is created.

Thereafter, opening with the first player and alternating play between the players the konane game progresses by locating a move comprising one of the playing zones that is filled with a playing piece designated for the use of the other player which is positioned along one of the horizontal and vertical rows between one of the vacant playing zones and one of the playing zones that is filled with a playing piece designated for the use of the player, moving a playing piece by selecting the playing piece designated for the use of the player from at least one located move, jumping the playing piece designated for the use of the player over the playing piece designated for the use of the other player, which is positioned along one of the horizontal and vertical rows between one of the vacant playing zones and one of the playing zones that is filled with a playing piece designated for the use of the player, on to the vacant playing zone, and removing from the playing area the playing piece designated for the use of the other player which was jumped. The previous two steps are repeated with the playing piece designated for the use of the player that was moved in the previous step, whereby victory is claimed by the last player to move.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

Figure 8:
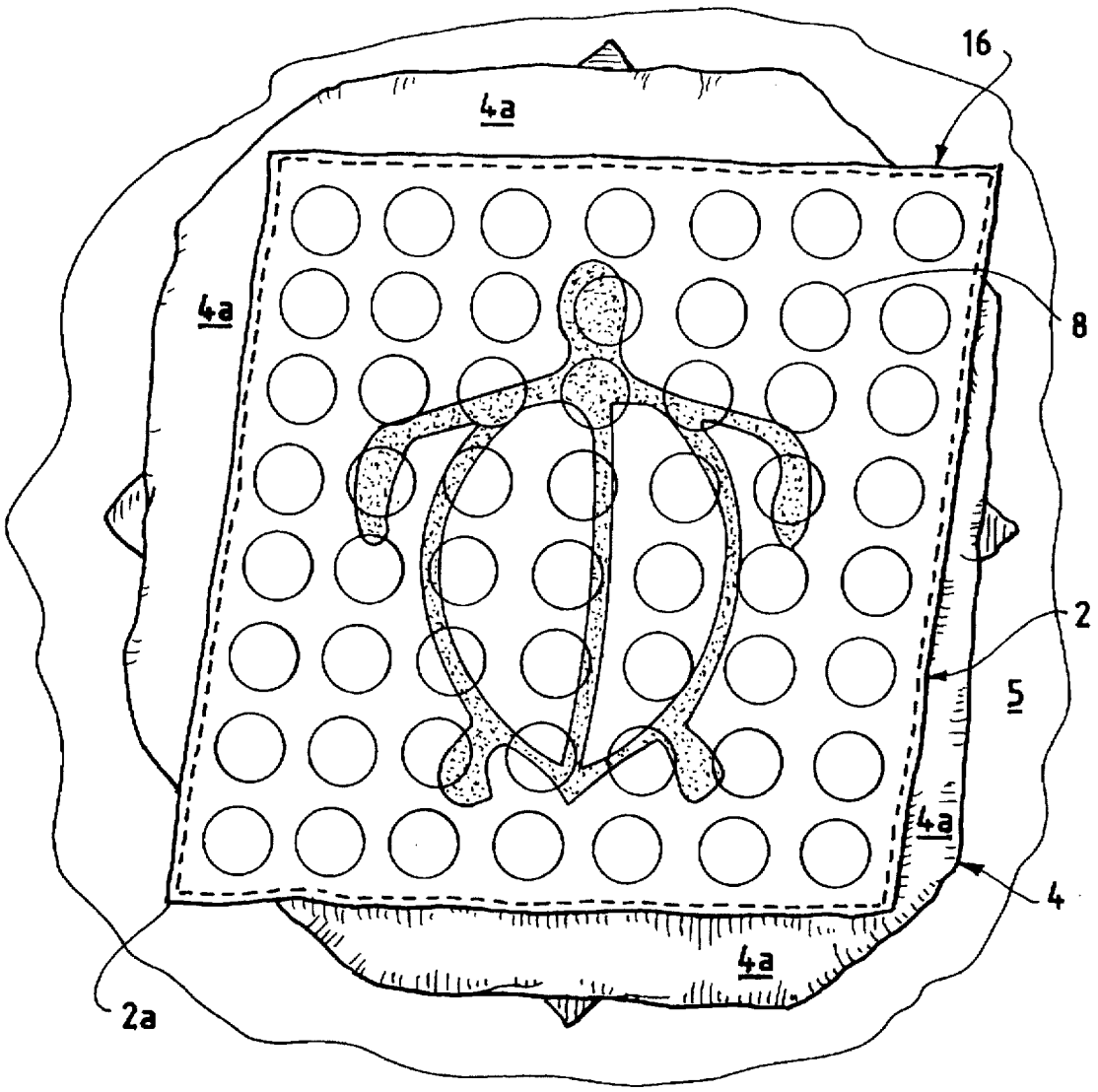
Figure 9:
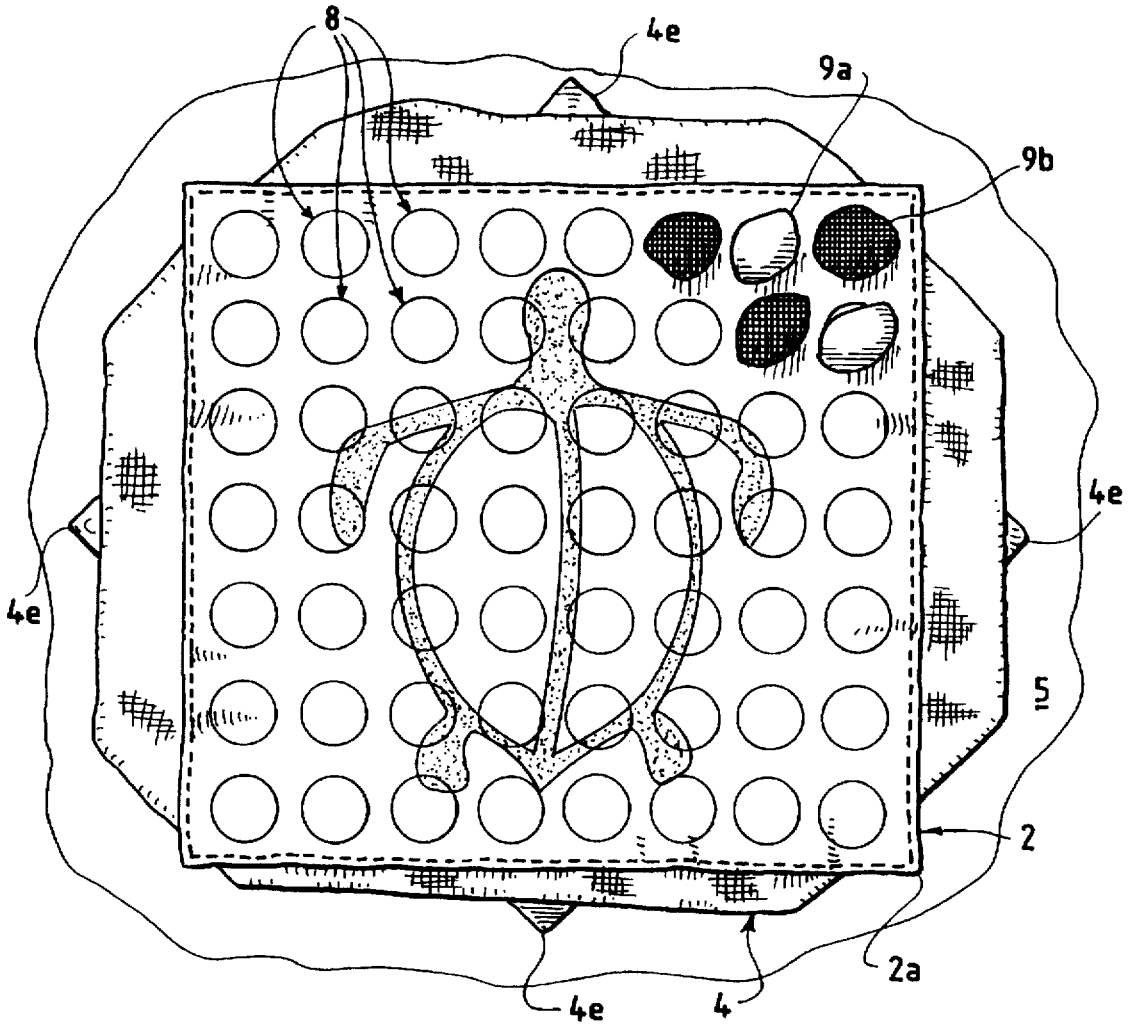

enlarged fragmentary view of the konane game of the present invention showing detail of the rope disposed in the passageway of a corner fold;

FIG. 8 is a top plan view of a second preferred embodiment of the playing area of the present invention showing a parallelogram shape; and FIG. 9 is a perspective view of a third preferred embodiment of the playing area of the present invention showing a rectangular shape with one more vertical column than horizontal rows and further showing a number of the playing pieces disposed on the playing zones.

DETAILED DESCRIPTION OF THE INVENTION

The discussion that follows, without limiting the scope of the invention, will refer to the invention as depicted in the drawing, showing a konane game that will play faster and more flexibly compared to the ancient manner of play. Furthermore, the konane game of the present invention is designed to be portable: a user of this new version can turn the playing surface into a sack and move the game to another site.

Figure 6:
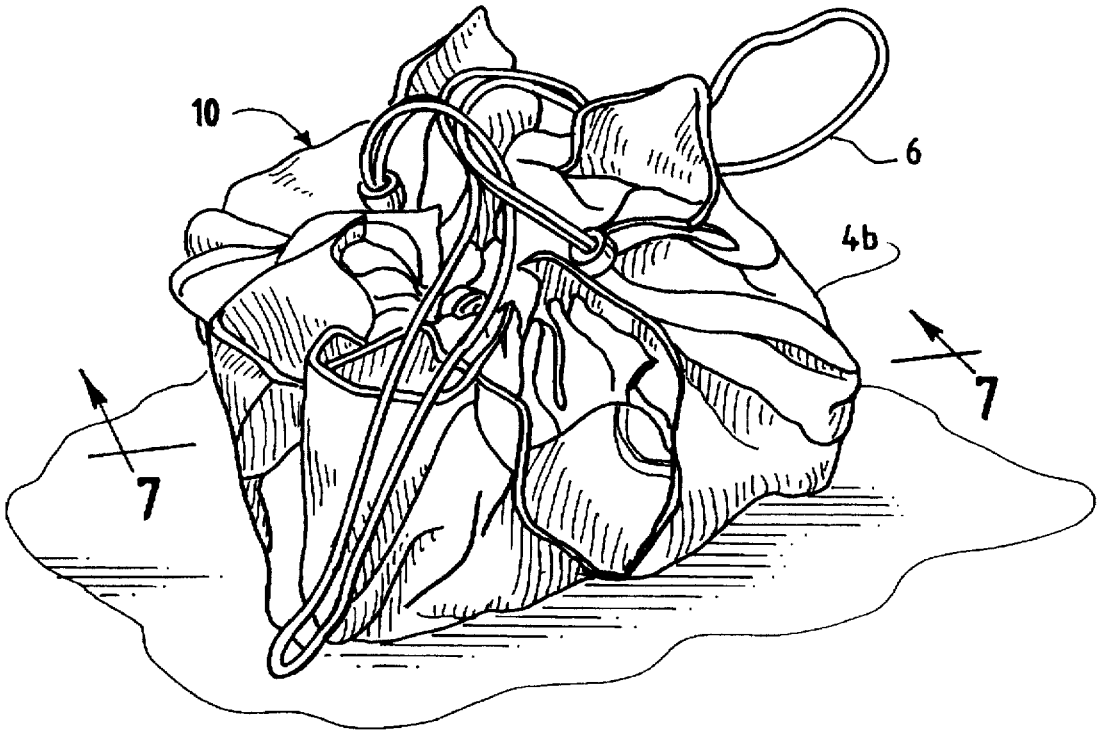
FIG. 6 is a perspective view of the closed cover sheet of the konane game forming a sack with the rope partially knotted.
Figure 7:
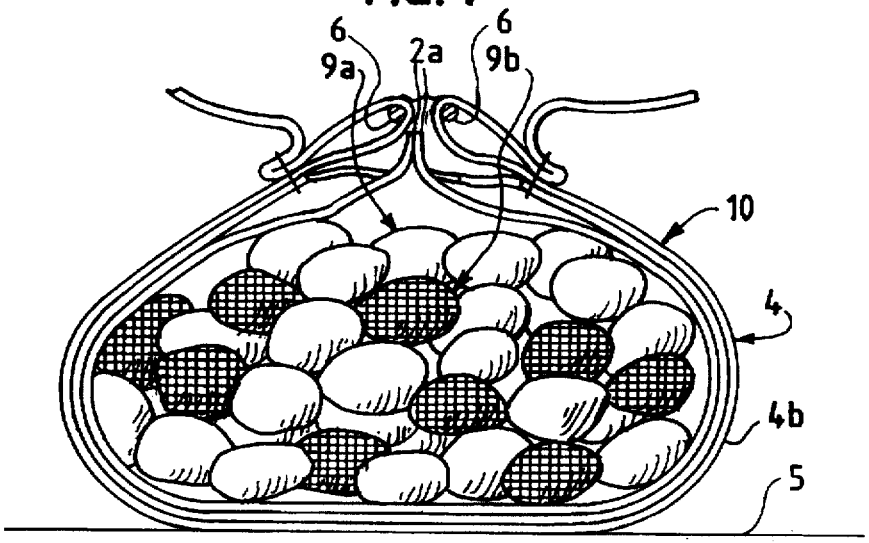
FIG. 7 is a side elevation view of the closed cover sheet of the konane game forming a sack taken along the line 7—7 of FIG. 6.

The instant invention is unique in that a separate game playing flexible sheet 2 and a cover sheet 4 may be provided, allowing the playable flat surface of the flexible sheet 2 to made portable merely as the four corners 2*a* are folded over as shown in FIG. 7, when the rope 6 is drawn scrunching the peripheral edge of the cover sheet to create the sack as best shown in FIG. 6. This allows for a greater variety of materials to be used for the playing surface—material that is not necessarily as flexible nor as resilient as it would have to be if it were scrunched by the drawn rope and then flattened to serve as the game board surface.

With respect to the following description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the following is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Figure 1:
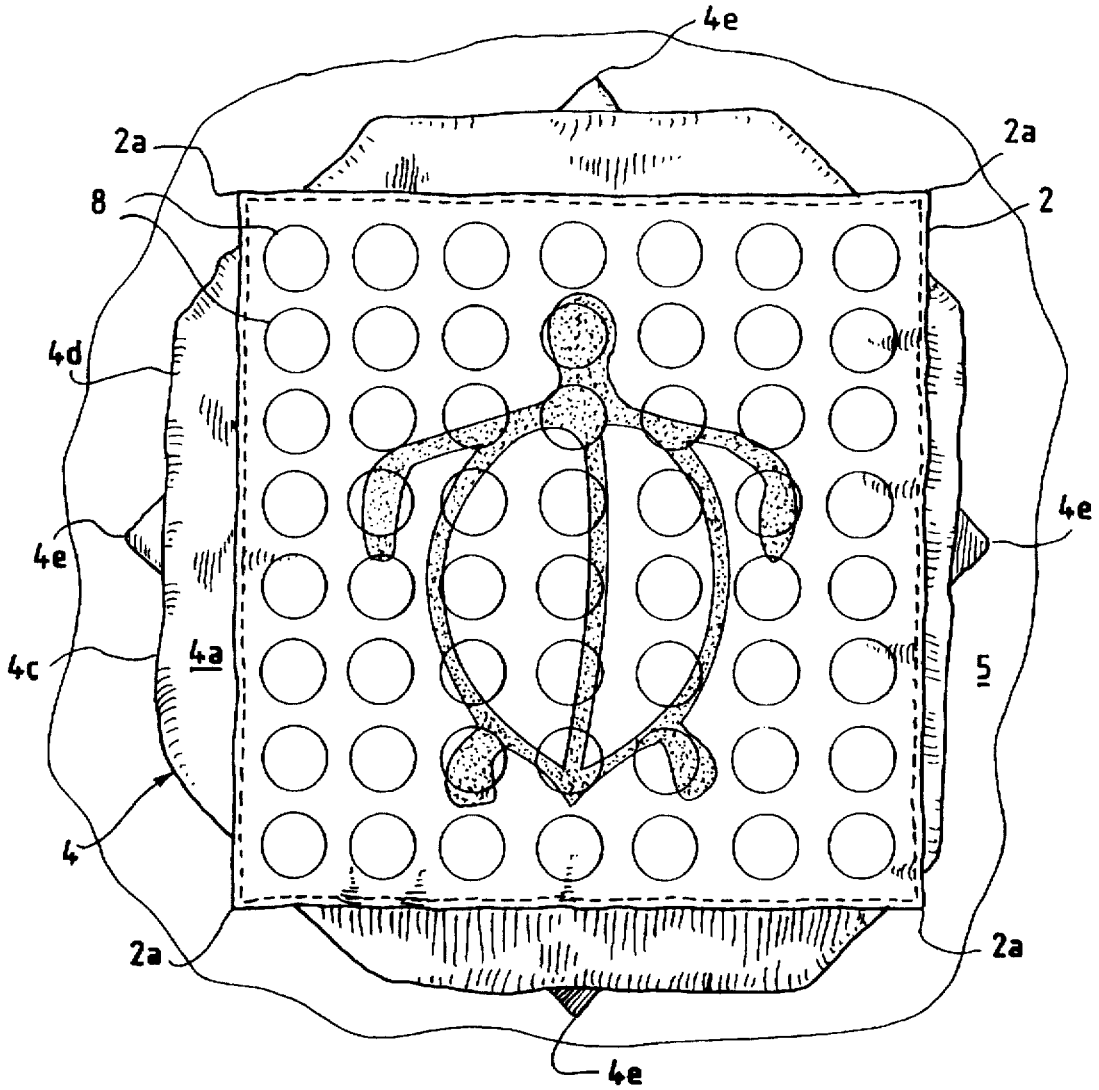
FIG. 1 is a top plan view of a first preferred embodiment of the konane game board with the sack open.
Figure 2:
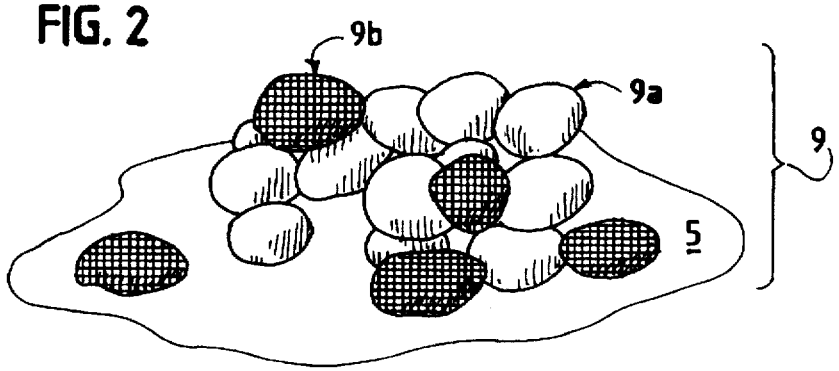
FIG. 2 is a perspective view of a plurality of playing pieces of a first designation (black) for use by the first player and a plurality of playing pieces of a second designation (white) for use by the second player.

The preferred embodiments of the konane game depicted in the drawing comprise a flexible sheet 2 that may be made flat as shown in FIG. 1. The flexible sheet 2 has a first surface 2b and a second surface 2c—the first surface of the sheet having a plurality of parallel rows, each row being defined by a plurality of generally evenly spaced zones such that each zone 8 from a row forms one of a series of zones of one of a series of parallel columns, each of the columns being transverse to each of the plurality of parallel rows.

A preferred embodiment of the konane game for a first player and a second player comprises a flexible playing area which may be laid flat divided into adjacent playing piece zones, where each zone 8 for receiving only a single playing piece 9 at any one time. The adjacent playing piece zones 8 are arranged in a n by n+1 grid forming distinct, serially linked, horizontal and vertical rows with a plurality of the playing pieces of the first designation 9a alternatingly disposed with a plurality corresponding in number and pattern of distribution of the playing pieces of the second designation 9b, whereby each of the playing piece zones 8 of the grid is filled.

The first surface 2b of the flexible sheet 2 or playing board may have a grid m by m+1 of rows and columns that is larger (i.e. m is greater than n). For such games the playing area is restricted to a smaller n by n+1 grid. In this way a variety of n by n+1 grids games may be used. Once the playing area grid is defined, unused zones 8 outside of the grid cannot be used as vacant locations during a move.

A plurality of first objects 9a and a plurality of second objects 9b corresponding generally in number to the plurality of first objects are further provided as playing pieces 9. The first objects are distinguishable from the second objects, and the first objects and the second objects are each suitably sized to be placed on the zones 8 of the first surface 2b of the sheet 2 free of interfering with the placement of any one of the first objects and the second objects positioned on an adjacent zone.

Figure 3:
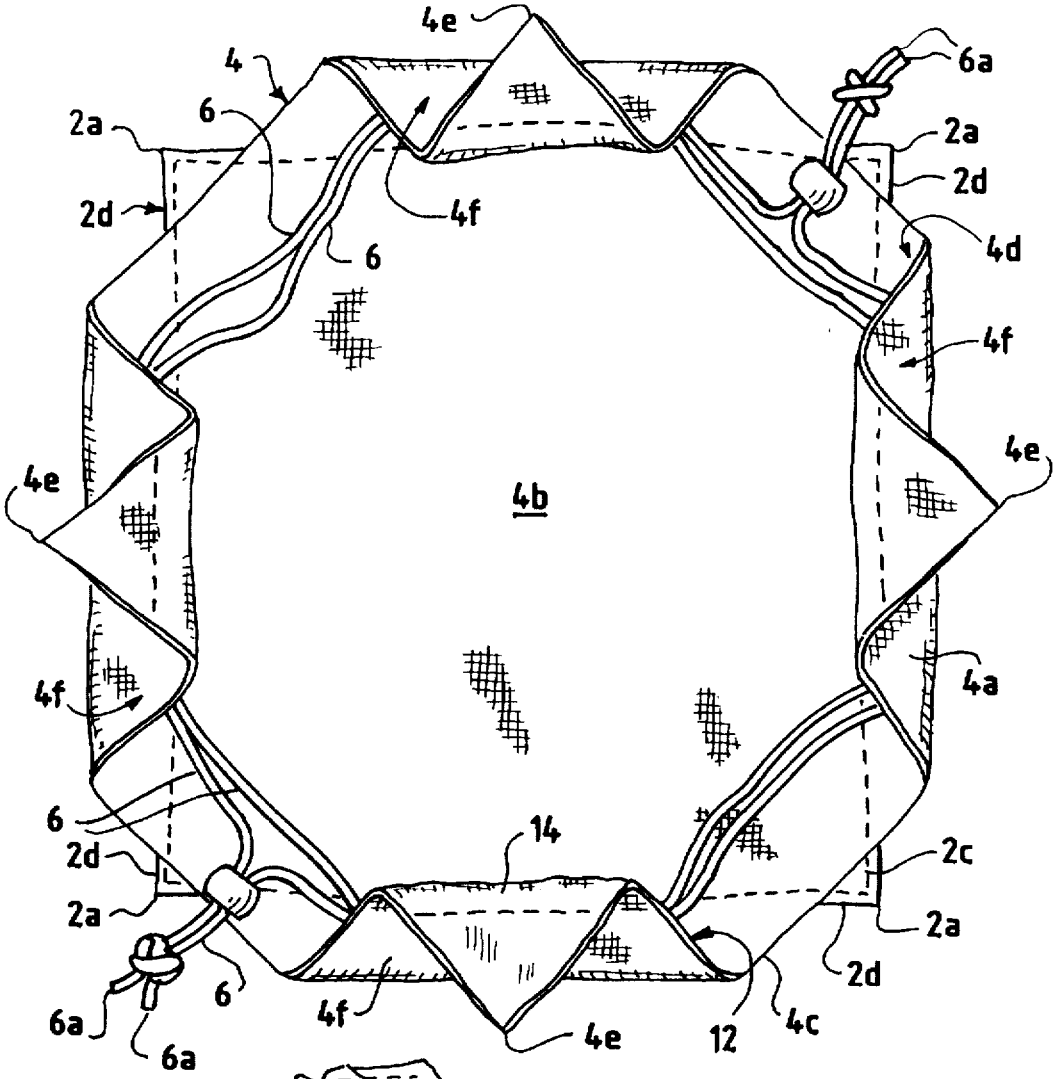
FIG. 3 is a bottom plan view of the konane game board cover sheet of FIG. 1, showing details of the interconnection between the rope and the corner folds.

Additionally at least one rope 6 is included. The rope is disposed adjacent to the second surface 2c of the sheet 2, as best shown in FIG. 3, whereby, the at least one rope 6 may be drawn independent of any contact with the placement of any one of the first objects and the second objects on the first surface 2b.

In a preferred embodiment of the konane game, the number of rows is greater by one than the number of columns. In another version, the number of columns is greater by one than number of rows. Or as can be readily appreciated the game board may merely be rotated.

In a preferred embodiment of the flexible sheet 2 of the konane game, it has a peripheral edge 2d to which the rope 6 is operatively associated, whereby when the ends 6a of the rope are drawn the peripheral edge 2d of the flexible sheet 2 is gathered together to form a sack 10.

Another preferred embodiment of the invention provides that the flexible sheet 2 has a peripheral edge 2d and further that it comprises a cover sheet 4 having an interior surface 4a and an exterior surface 4b with the interior surface disposed adjacent to the second surface 2c of the flexible sheet, the cover sheet 4 having a peripheral edge 4c and at least one maximum transverse dimension greater than the dimension of the flexible sheet 2 lying along the at least one transverse dimension, whereby the peripheral edge 4c of cover sheet lying along the at least one transverse dimension extends over the peripheral edge 2d of the flexible sheet lying along the at least one transverse dimension to form at least one overlap 4d, and wherein the at least one rope is operatively associated with the at least one overlap, whereby when the ends of the rope are drawn the at least one overlap of the cover sheet is gathered together to form a sack 10.

Figure 4:
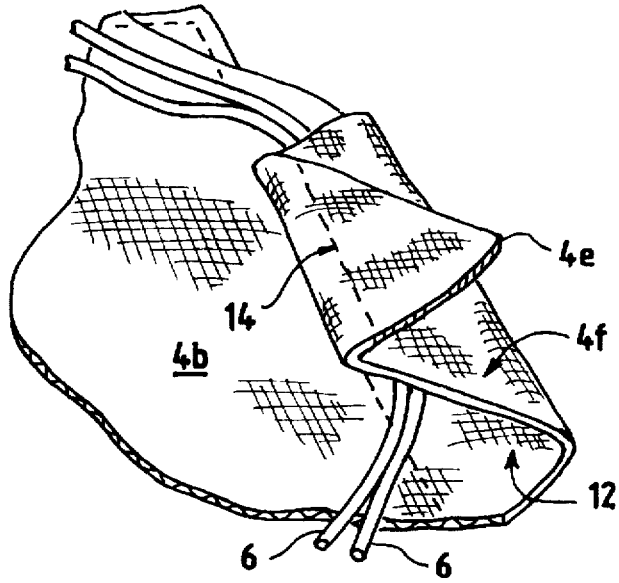
FIG. 4 is a fragmentary perspective view of the konane game board cover sheet showing details of the interconnection between the rope and the corner folds.
Figure 5:
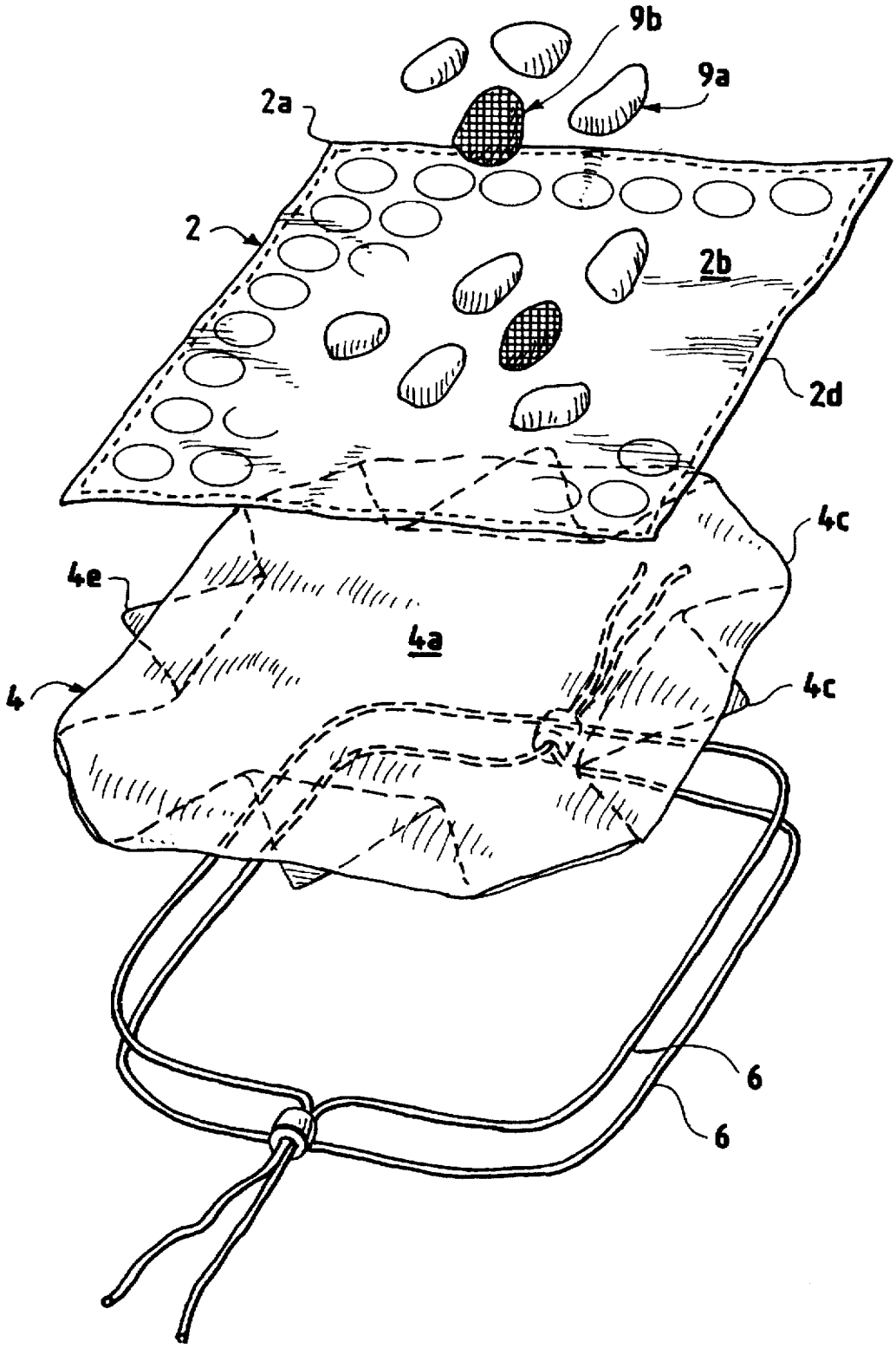
FIG. 5 is an exploded perspective view of the elements of the konane game to show the interconnection details of the playing pieces, flexible sheet, cover sheet and rope.

In a preferred embodiment of the konane game 1 referred to in FIGS. 3 and 4, the peripheral edge 4c of the cover sheet has four corners 4e and each of the corners are folded onto the exterior surface 4b to form an overlay 4f with a passageway 12 disposed therebetween and means for attaching 14, such as stitching, is provided to secure the overlay 4f, and wherein the at least one rope 6 passes through each of the passageways 12, whereby when the ends 6a of the at least one rope are drawn, the four corners 4e of the cover sheet 4 are gathered together to form a sack 10.

Preferably, the cover sheet 4 is suitably sized to form a sack 10 capable of holding all of the playing pieces 9. The flexible sheet 2 is preferably generally rectangular in shape as shown in FIGS. 1, 3, 5 and 9. Alternatively, it may have the shape of a parallelogram as shown in FIG. 8.

Referring to FIG. 9, a preferred embodiment of the konane game for a first player and a second player comprises at least ten playing pieces of a first designation 9a for use by the first player and at least ten playing pieces of a second designation 9b for use by the second player, and a flexible playing sheet 4 which may be laid flat on a flat horizontal surface 5, such as a table top, divided into adjacent playing piece zones 8, where each zone for receiving only a single playing piece 9 at any one time. The adjacent playing piece zones arranged in a n by n+1 grid forming distinct, serially linked, horizontal and vertical rows with a plurality of the playing pieces of the first designation 9a alternatingly disposed with a plurality corresponding in number and pattern of distribution of the playing pieces of the second designation 9b, whereby each of the playing piece zones of the grid is filled. FIG. 9 is only partially filled with playing pieces for illustration purposes.

A preferred method of playing a konane game of the instant invention for a first player and a second player comprising the following steps: providing at least ten playing pieces of a first designation for use by the first player and at least ten playing pieces of a second designation for use by the second player; providing a playing area divided into adjacent playing piece zones, each zone for receiving only a single playing piece at any one time, the adjacent playing piece zones arranged in a n by n+1 grid forming distinct, serially linked, horizontal and vertical rows; placing of one ofp1506playing pieces of the first designation on any one of the playing piece zones, to fill the playing piece zone; placing of one of the playing pieces of the second designation on each of the playing piece zones horizontally and vertically adjacent to the playing piece zone filled on the previous step; placing of one of the playing pieces of the first designation on each of the playing piece zones horizontally and vertically adjacent to the playing piece zone filled on the previous step; repeating the previous two steps until all playing piece zones are filled; removing one of the playing pieces of the first designation from the playing area by the first player, to create a vacant playing zone; removing one of the playing pieces of the second designation from the playing area by the second player, whereby a second vacant playing zone is created; opening with the first player and alternating play between the players thereafter: locating a move comprising one of the playing zones that is filled with a playing piece designated for the use of the other player which is positioned along one of the horizontal and vertical rows between one of the vacant playing zones and one of the playing zones that is filled with a playing piece designated for the use of the player; moving a playing piece by selecting the playing piece designated for the use of the player from at least one located move, jumping the playing piece designated for the use of the player over the playing piece designated for the use of the other player, which is positioned along one of the horizontal and vertical rows between one of the vacant playing zones and one of the playing zones that is filled with a playing piece designated for the use of the player, on to the vacant playing zone, and removing from the playing area the playing piece designated for the use of the other player which was jumped; and repeating the previous two steps with the playing piece designated for the use of the player that was moved in the previous step, whereby victory is claimed by the last player to move.

In a second preferred method of playing a konane game of this invention for a first player and a second player the steps comprise: providing at least ten playing pieces of a first designation for use by the first player and at least ten playing pieces of a second designation for use by the second player; providing a playing area divided into adjacent playing piece zones, each zone for receiving only a single playing piece at any one time, the adjacent playing piece zones arranged in a n by n+1 grid forming distinct, serially linked, horizontal and vertical rows; placing of one of the playing pieces of the first designation on any one of the playing piece zones, to fill the playing piece zone; placing of one of the playing pieces of the second designation on each of the playing piece zones horizontally and vertically adjacent to the playing piece zone filled on the previous step; placing of one of the playing pieces of the first designation on each of the playing piece zones horizontally and vertically adjacent to the playing piece zone filled on the previous step.

The last two steps are repeated until all playing piece zones are filled. Then one of the playing pieces of the first designation is removed from the playing area (playing sheet) by the first player, to create a vacant playing zone; one of the playing pieces of the second designation is removed from the playing area by the second player, whereby a second vacant playing zone is created.

Then, opening with the first player and alternating play between the players thereafter: a move comprising one of the playing zones that is filled with a playing piece designated for the use of the other player which is positioned along one of the horizontal and vertical rows between one of the vacant playing zones and one of the playing zones that is filled with a playing piece designated for the use of the player is located. A playing piece is moved by selecting the playing piece designated for the use of the player from at least one located move, jumping the playing piece designated for the use of the player over the playing piece designated for the use of the other player, which is positioned along one of the horizontal and vertical rows between one of the vacant playing zones and one of the playing zones that is filled with a playing piece designated for the use of the player, on to the vacant playing zone, and removing from the playing area the playing piece designated for the use of the other player which was jumped.

Optionally, the previous two steps may be repeated with the playing piece designated for the use of the player that was moved in the previous step, whereby victory is claimed by the last player to move.

The foregoing method of playing the game, wherein the playing area comprises a flexible sheet, may further include the additional step of unfolding the playing area to expose a flat playing surface. Furthermore, when the flexible sheet of the konane game has a peripheral edge and at least one rope having operatively associated with the peripheral edge of the flexible sheet, the method of play may include an additional step of drawing the ends of the rope to gather together the peripheral edge of the flexible sheet to form a sack that is suitably sized to hold the playing pieces.

The invention resides not in any one of these features per se, but rather in the particular combination of all of them herein disclosed and claimed and it is distinguished from the prior art in this particular combination of all of its structures for the function specified.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Further, the purpose of the following abstract is to enable the U.S. Patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed as being new and desired to be protected by Letters Patent of the United States is a follows:

1. A method of playing a konane game for a first player and a second player comprising the following steps:

a. providing at least ten playing pieces of a first designation for use by the first player and at least ten playing pieces of a second designation for use by the second player;

b. providing a playing area divided into adjacent playing piece zones, each zone for receiving only a single playing piece at any one time, said adjacent playing piece zones arranged in a n by n+1 grid forming distinct, serially linked, horizontal and vertical rows;

c. placing of one of the playing pieces of the first designation on any one of the playing piece zones, to fill said playing piece zone;

d. placing of one of the playing pieces of the second designation on each of the playing piece zones horizontally and vertically adjacent to the playing piece zone filled on the previous step;

e. placing of one of the playing pieces of the first designation on each of the playing piece zones horizontally and vertically adjacent to the playing piece zone filled on the previous step;

f. repeating the previous two steps until all playing piece zones are filled;

g. removing one of the playing pieces of the first designation from the playing area by the first player, to create a vacant playing zone;

h. removing one of the playing pieces of the second designation from the playing area by the second player, whereby a second vacant playing zone is created;

i. opening with the first player and alternating play between the players thereafter:

(1) locating a move comprising one of the playing zones that is filled with a playing piece designated for the use of the other player which is positioned along one of the horizontal and vertical rows between one of the vacant playing zones and one of the playing zones that is filled with a playing piece designated for the use of the player;

(2) moving a playing piece by selecting the playing piece designated for the use of the player from at least one located move, jumping said playing piece designated for the use of the player over the playing piece designated for the use of the other player, which is positioned along one of the horizontal and vertical rows between one of the vacant playing zones and one of the playing zones that is filled with a playing piece designated for the use of the player, on to the vacant playing zone, and removing from the playing area the playing piece designated for the use of the other player which was jumped; and (3) repeating the previous two steps with the playing piece designated for the use of the player that was moved in the previous step, whereby victory is claimed by the last player to move.

2. A method of playing a konane game for a first player and a second player comprising the following steps:

a. providing at least ten playing pieces of a first designation for use by the first player and at least ten playing pieces of a second designation for use by the second player;

b. providing a playing area divided into adjacent playing piece zones, each zone for receiving only a single playing piece at any one time, said adjacent playing piece zones arranged in a n by n+1 grid forming distinct, serially linked, horizontal and vertical rows;

c. placing of one of the playing pieces of the first designation on any one of the playing piece zones, to fill said playing piece zone;

d. placing of one of the playing pieces of the second designation on each of the playing piece zones horizontally and vertically adjacent to the playing piece zone filled on the previous step;

e. placing of one of the playing pieces of the first designation on each of the playing piece zones horizontally and vertically adjacent to the playing piece zone filled on the previous step;

f. repeating the previous two steps until all playing piece zones are filled;

g. removing one of the playing pieces of the first designation from the playing area by the first player, to create a vacant playing zone;

h. removing one of the playing pieces of the second designation from the playing area by the second player, whereby a second vacant playing zone is created;

i. opening with the first player and alternating play between the players thereafter:

(1) locating a move comprising one of the playing zones that is filled with a playing piece designated for the use of the other player which is positioned along one of the horizontal and vertical rows between one of the vacant playing zones and one of the playing zones that is filled with a playing piece designated for the use of the player;

(2) moving a playing piece by selecting the playing piece designated for the use of the player from at least one located move, jumping said playing piece designated for the use of the player over the playing piece designated for the use of the other player, which is positioned along one of the horizontal and vertical rows between one of the vacant playing zones and one of the playing zones that is filled with a playing piece designated for the use of the player, on to the vacant playing zone, and removing from the playing area the playing piece designated for the use of the other player which was jumped; and (3) optionally, repeating the previous two steps with the playing piece designated for the use of the player that was moved in the previous step, whereby victory is claimed by the last player to move.

3. The method of playing the konane game of claim 2, wherein the playing area comprises a flexible sheet, including the additional step of unfolding the playing area to expose a flat playing surface.

4. The method of playing the konane game of claim 3, wherein the flexible sheet has a peripheral edge and at least one rope having operatively associated with the peripheral edge of the flexible sheet, including the additional step of drawing the ends of the rope to gather together the peripheral edge of the flexible sheet to form a sack that is suitably sized to hold the playing pieces.

5. An apparatus for a konane game comprising:

a. a flexible sheet that may be made flat, said flexible sheet having a first surface and a second surface, said first surface of the sheet having a plurality of parallel rows, each row being defined by a plurality of generally evenly spaced zones such that each zone from a row forms one of a series of zones of one of a series of parallel columns, each of said columns being transverse to each of said plurality of parallel rows;

b. a plurality of first objects and a plurality of second objects corresponding generally in number to the plurality of first objects, said first objects being distinguishable from the second objects, said first objects and said second objects being each suitably sized to be placed on the zones of the first surface of the sheet free of interfering with the placement of any one of said first objects and said second objects positioned on an adjacent zone; and c. at least one rope, said rope being disposed adjacent to the second surface of the sheet, whereby, said at least one rope may be drawn independent of any contact with the placement of any one of said first objects and said second objects on the first surface.

6. The apparatus for a konane game of claim 5 wherein the number of rows is greater by one than the number of columns.

7. The apparatus for a konane game of claim 5 wherein the number of columns is greater by one than number of rows.

8. The apparatus for a konane game of claim 5 wherein the flexible sheet has a peripheral edge to which the rope is operatively associated, whereby when the ends of the rope are drawn the peripheral edge of the flexible sheet is gathered together to form a sack.

9. The apparatus for a konane game of claim 5 wherein the flexible sheet has a peripheral edge and further comprising a cover sheet having an interior surface and an exterior surface with the interior surface disposed adjacent to the second surface of the flexible sheet, said cover sheet having a peripheral edge and at least one maximum transverse dimension greater than the dimension of said flexible sheet lying along said at least one transverse dimension, whereby the peripheral edge of cover sheet lying along said at least one transverse dimension extends over the peripheral edge of the flexible sheet lying along said at least one transverse dimension to form at least one overlap, and wherein the at least one rope is operatively associated with the at least one overlap, whereby when the ends of the rope are drawn the at least one overlap of the cover sheet is gathered together to form a sack.

10. The apparatus for a konane game of claim 9 wherein the cover sheet is suitably sized to form a sack capable of holding all of the playing pieces.

11. The apparatus for a konane game of claim 10 wherein the peripheral edge of the cover sheet has four corners and each of said corners are folded onto the exterior surface to form an overlay with a passageway disposed therebetween and means for attaching is provided to secure said overlay, and wherein the at least one rope passes through each of said passageways, whereby when the ends of the at least one rope are drawn, the four corners of the cover sheet are gathered together to form a sack.

12. The apparatus for a konane game of claim 5 wherein said flexible sheet is generally rectangular in shape.

13. The apparatus for a konane game of claim 5 wherein said flexible sheet has the shape of a parallelogram.

14. An apparatus for a konane game for a first player and a second player comprising:

a. at least ten playing pieces of a first designation for use by the first player and at least ten playing pieces of a second designation for use by the second player; and b. a flexible playing area which may be laid flat divided into adjacent playing piece zones, each zone for receiving only a single playing piece at any one time, said adjacent playing piece zones arranged in a n by n+1 grid forming distinct, serially linked, horizontal and vertical rows with a plurality of the playing pieces of the first designation alternatingly disposed with a plurality corresponding in number and pattern of distribution of the playing pieces of the second designation, whereby each of the playing piece zones of the grid is filled.

* * * * *